US009241567B1

(12) United States Patent
Davis

(10) Patent No.: US 9,241,567 B1
(45) Date of Patent: Jan. 26, 2016

(54) APPLIANCE GUARD AND METHOD

(71) Applicant: Melody B. Davis, Greensboro, NC (US)

(72) Inventor: Melody B. Davis, Greensboro, NC (US)

(73) Assignee: M. Davis and Associates, LLC, Greensboro, NC (US)

( * ) Notice: Subject to any disclaimer, the term of this patent is extended or adjusted under 35 U.S.C. 154(b) by 0 days.

(21) Appl. No.: 14/623,040

(22) Filed: Feb. 16, 2015

(51) Int. Cl.

| | |
|---|---|
| ***A47B 17/00*** | (2006.01) |
| ***A47B 95/00*** | (2006.01) |
| ***D06F 39/12*** | (2006.01) |
| ***D06F 39/00*** | (2006.01) |

(52) U.S. Cl.
CPC ..... *A47B 95/002* (2013.01); *D06F 39/00* (2013.01); *D06F 39/12* (2013.01); *A47B 2095/004* (2013.01)

(58) Field of Classification Search
CPC ..... A47B 95/043; A47B 2095/046; A47B 77/027; A47B 13/083; A47B 13/08; A47B 2077/027
USPC ..... 108/27; 248/206.5, 345.1; 312/330.1, 312/137, 140.4, 140.1
See application file for complete search history.

(56) References Cited

U.S. PATENT DOCUMENTS

| | | | | | |
|---|---|---|---|---|---|
| 2,785,937 | A * | 3/1957 | Murray | 108/42 |
| 2,970,872 | A * | 2/1961 | Ullman, Jr | 108/27 |
| 3,181,176 | A * | 5/1965 | Nagy et al. | 108/27 |
| 3,628,841 | A * | 12/1971 | Sulcek | 312/204 |
| 3,773,399 | A * | 11/1973 | Sulcek | 312/204 |
| 3,779,624 | A * | 12/1973 | Werderitsch | 248/345.1 |
| 4,605,292 | A * | 8/1986 | McIntosh | 248/205.3 |
| 4,787,366 | A * | 11/1988 | Bell | 126/500 |
| 5,199,415 | A * | 4/1993 | Johnson, Jr. | 108/27 |
| 5,452,666 | A * | 9/1995 | Peters | 108/27 |
| 5,452,739 | A * | 9/1995 | Mustee et al. | 137/312 |
| 5,496,609 | A * | 3/1996 | Michelstein | 108/27 |
| 6,647,899 | B1 * | 11/2003 | Lysien | 108/27 |
| 6,840,591 | B2 * | 1/2005 | Wessel | 248/345.1 |
| 8,424,467 | B2 * | 4/2013 | Giampavolo et al. | 108/27 |
| 8,522,771 | B2 * | 9/2013 | McConnell et al. | 108/27 |
| 8,789,475 | B1 * | 7/2014 | Giampavolo et al. | 108/27 |

FOREIGN PATENT DOCUMENTS

| | | |
|---|---|---|
| EP | 2580383 | 12/2011 |

* cited by examiner

*Primary Examiner* — Jose V Chen
(74) *Attorney, Agent, or Firm* — Blake P. Hurt; Tuggle Duggins P.A.

(57) ABSTRACT

An appliance guard including a magnetic strip defining a magnetic field of at least two hundred fifty (250) Gauss units attached to a polymeric kick plate defining an outwardly angled bottom portion for preventing articles from accessing the void under an appliance is provided. The kick plate is four inches (4.0") wide and overlaps about a half an inch (0.5") with the magnetic strip which is three inches (3.0") wide, and each have a length sufficient to cover the front and lateral sides of a conventional appliance. A method of preventing articles from accessing the void beneath the appliance and become lost is also provided.

2 Claims, 6 Drawing Sheets

APPLIANCE GUARD AND METHOD

FIELD OF THE INVENTION

The invention herein pertains to protective guards and particularly pertains to a deformable magnetic guard placed at the base of an appliance such as a washing machine or dryer to prevent the loss of clothing articles.

DESCRIPTION OF THE PRIOR ART AND OBJECTIVES OF THE INVENTION

The phenomenon of socks, undergarments, and other articles of clothing disappearing in the washing machine and drying machine is well-known in our society, to the point where it has approached a cliché. Nearly all users of these appliances have experienced the aggravation to wash a load of laundry and realize at the conclusion that a single sock remains unmatched. One source for this frustration is the small gaps common between appliances and the floor and surrounding walls. Despite the highest levels of caution by a user, articles of clothing invariably end up under the appliance, not to be recovered until the machine is moved. Given the size and relative bulk of these appliances, it may be weeks or even years until the missing items can be recovered. Efforts can be made to secure a washing machine or a dryer into a corner, but this can create issues, particularly with the drying machine which requires air flow into and out of the machine, meaning that "snugging" a dryer into a corner may have detrimental effect on the machine itself. Thus, in view of the problems and disadvantages associated with prior art devices, the present invention was conceived and one of its objectives is to provide an appliance guard that protects from inadvertent articles accessing the space below an appliance.

It is another objective of the present invention to provide an appliance guard that releasably affixes to the front and side of an appliance.

It is still another objective of the present invention to provide an appliance guard that magnetically attaches to an appliance.

It is yet another objective of the present invention to provide an appliance guard with a magnetic portion and a polymeric portion.

It is a further objective of the present invention to provide a protective guard that is inexpensive to manufacture and simple to deploy.

It is still a further objective of the present invention to provide an appliance guard that wraps around the front and lateral sides of an appliance.

It is yet a further objective of the present invention to provide an appliance guard with a polymeric kick plate defining an outwardly extending bottom portion.

Various other objectives and advantages of the present invention will become apparent to those skilled in the art as a more detailed description is set forth below.

SUMMARY OF THE INVENTION

The aforesaid and other objectives are realized by providing an appliance guard formed from a strip of magnetic material three inches (3.0") wide, a sixteenth of an inch (0.62") thick, defining a magnet strength of at least three hundred (300) Gauss units, and of sufficient length to wrap around the front and lateral sides of a conventional appliance such as a washing or drying machine. The magnetic strip is attached to a deformable polymeric kick plate four inches (4.0) wide and of the same length as the magnetic strip, and defining an outwardly angled bottom portion configured to prevent socks, undergarments, and other articles of clothing from inadvertently gaining access to the space underneath the appliance. A method of preventing articles from becoming lost under a washing machine or other appliances is also provided.

DETAILED DESCRIPTION OF THE PREFERRED EMBODIMENT AND OPERATION OF THE INVENTION

Figure 1:
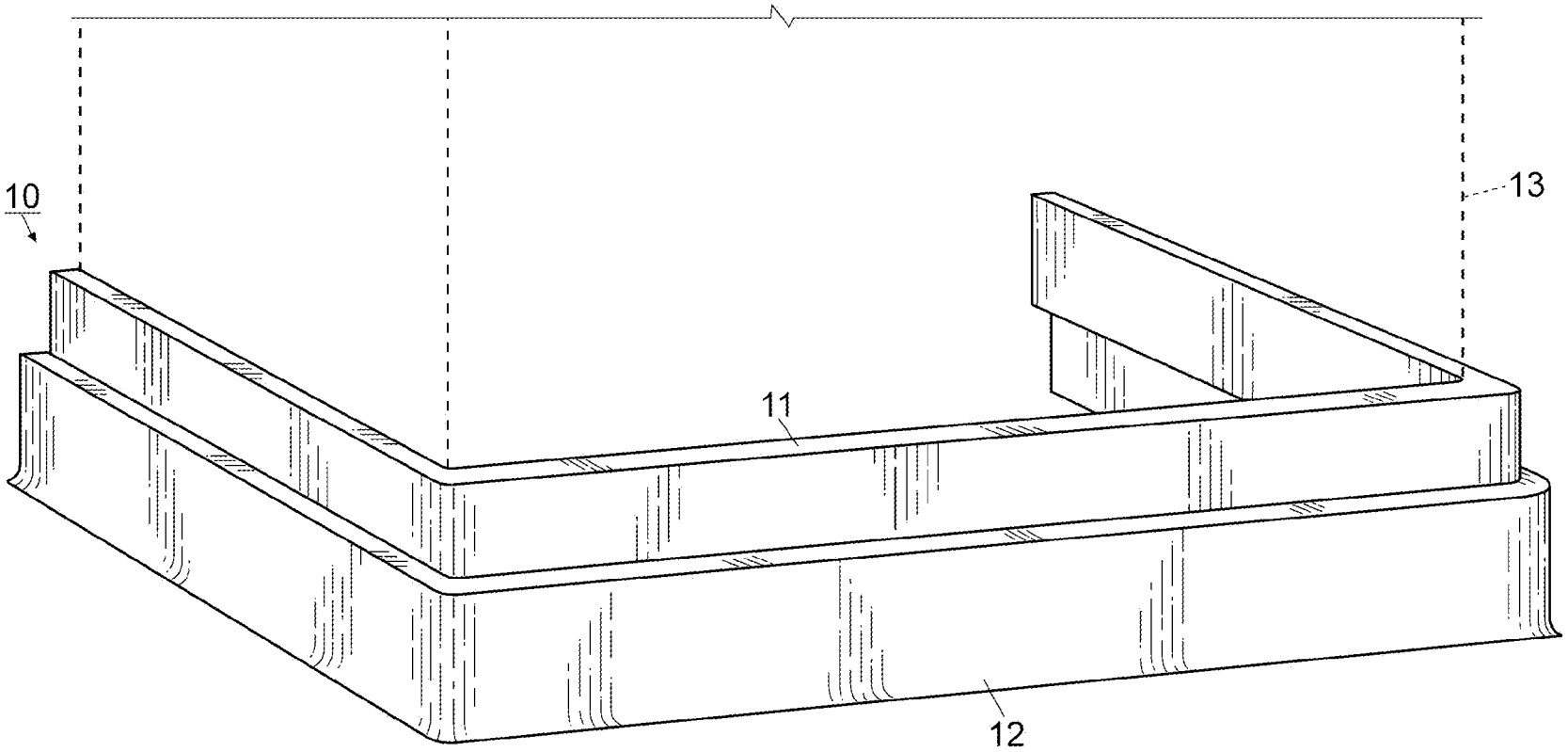
FIG. 1 depicts a front, side perspective view of an appliance guard as positioned around an appliance shown in dotted lines.

For a better understanding of the invention and its operation, turning now to the drawings, FIGS. 1-6 display the preferred embodiment of appliance guard 10 including magnetic strip 11 attached to polymeric kick plate 12. In FIG. 1, appliance guard 10 is disposed around the base of appliance 13, represented in dotted line, schematic fashion in FIG. 1. While appliance 13 will be discussed herein as the bottom portion or either a conventional washing or drying machine, it should be understood that appliance 13 may be any metallic appliance such as a refrigerator, oven, dishwasher, or other appliance known in the art. It should be understood that while appliance guard 10 is illustrated and discussed herein as being formed from magnetic strip 11 and kick plate 12, embodiments of appliance guard 10 may be integrally formed from these members (i.e. one piece or unitary construction, with or without an overlap) as well.

Figure 2:
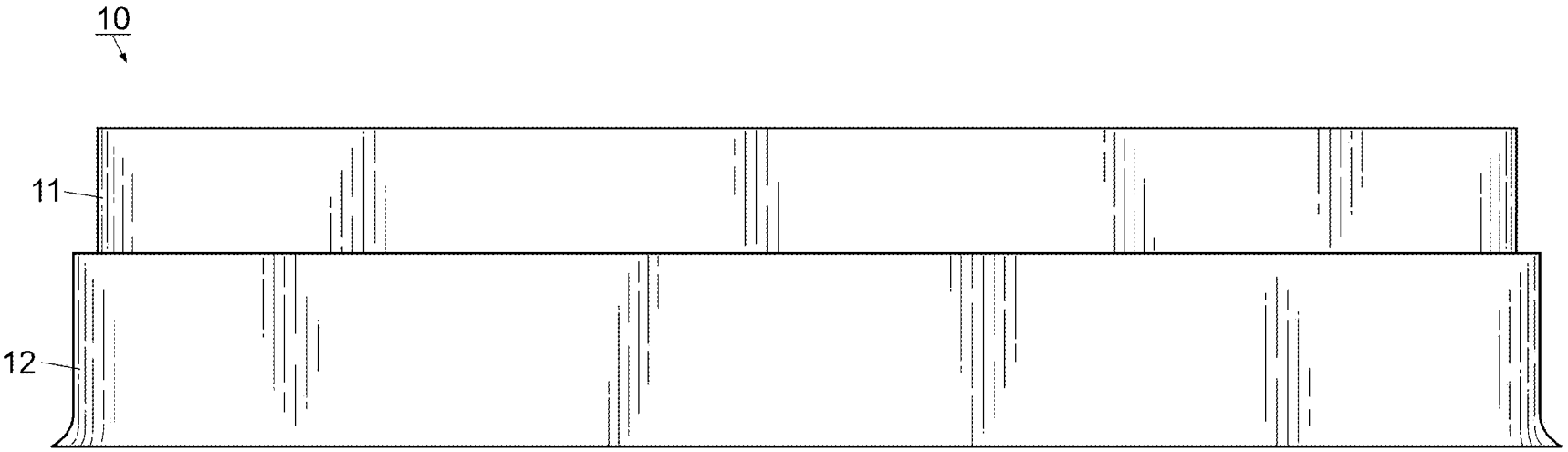
FIG. 2 shows an elevated front view of the guard of FIG. 1.
Figure 3:
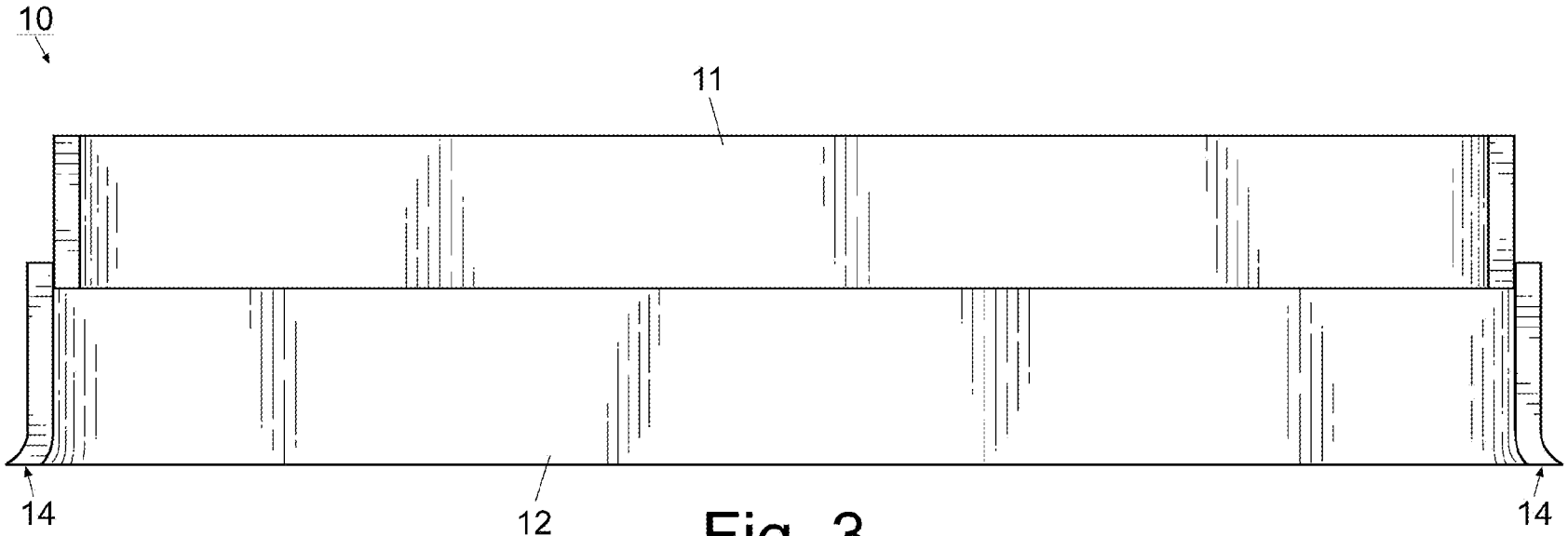
FIG. 3 pictures an elevated rear view of the guard of FIG. 1.
Figure 4:
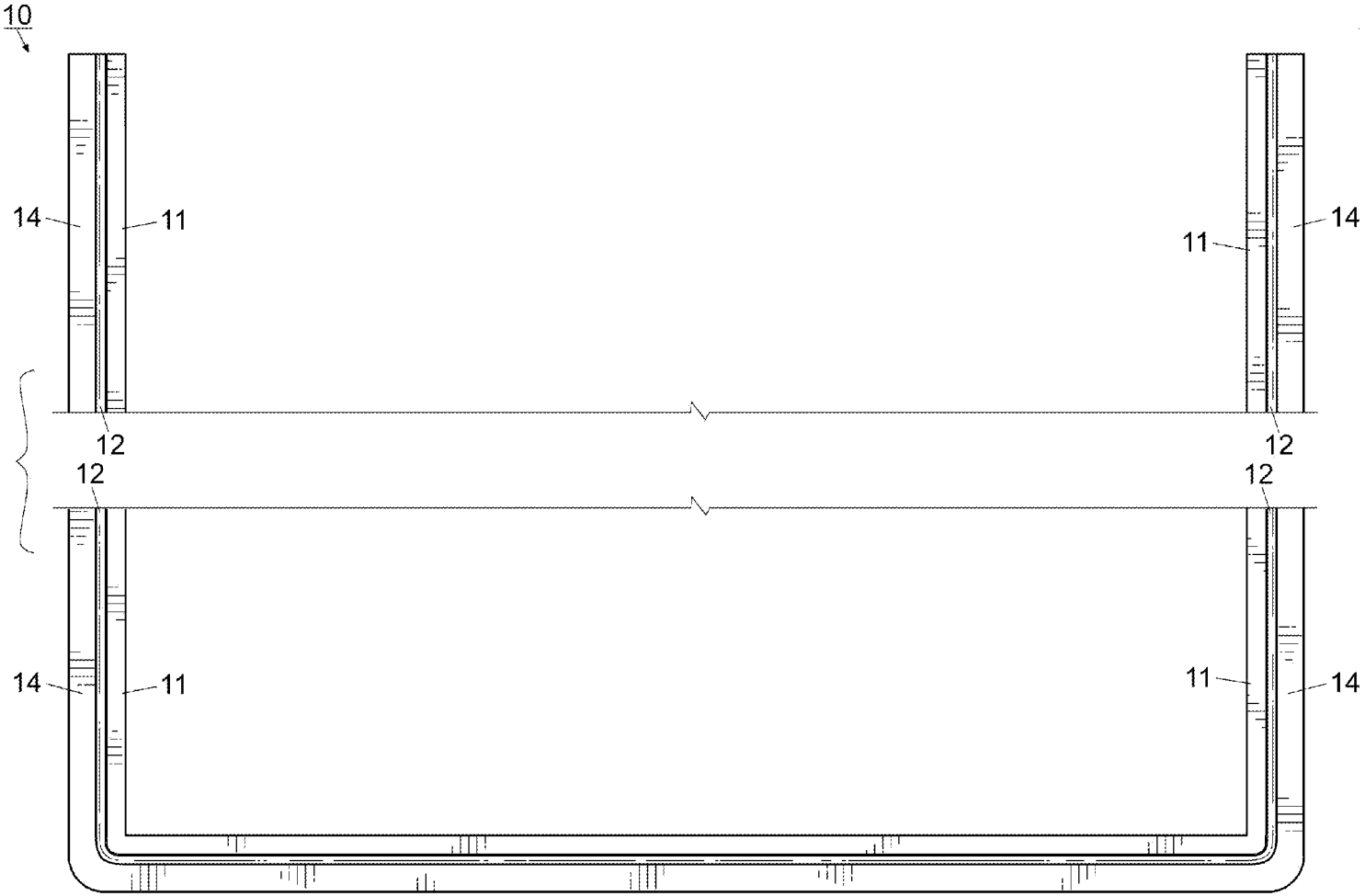
FIG. 4 depicts a bottom plan view of the guard of FIG. 1.
Figure 5:
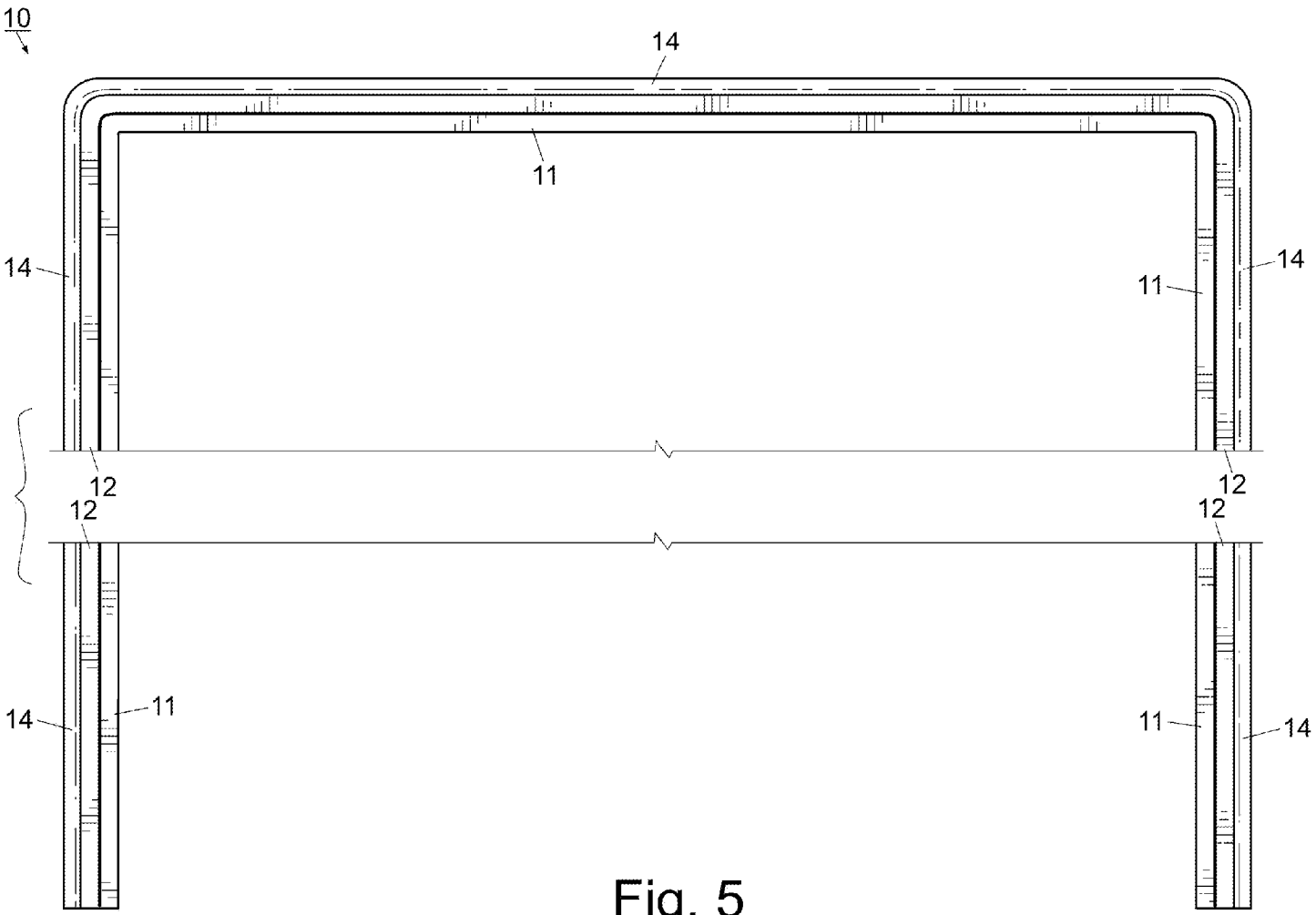
FIG. 5 demonstrates a top plan view of the guard of FIG. 1.
Figure 6:
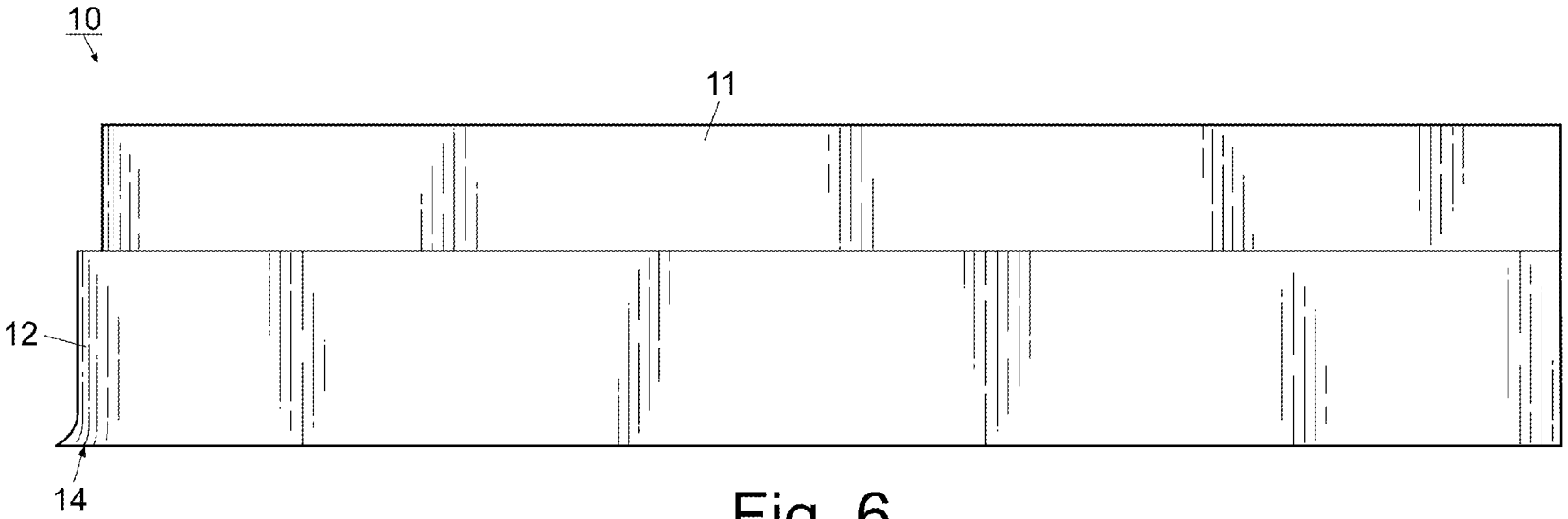
FIG. 6 illustrates an elevated side view of the guard of FIG. 1.

FIGS. 1, 2 and 3 illustrate the preferred configuration of magnetic strip 11. An embodiment of magnetic strip 11 defines a width of three inches (3.0"), a thickness of one sixteenth of an inch (0.062"), and a length of at least ninety inches (90.0") and formed from a material capable of producing a magnetic field that can attract ferromagnetic substances. These dimensions provide sufficient surface area to releasably adhere magnet strip 11 to appliance 13 via a magnetic field as well be described further below, and should not be considered arbitrary. Preferred magnetic strip 11 defines a through-the-thickness polarity, meaning that the opposing poles are oriented on opposing exterior surfaces of magnetic strip 11 (although alternate configurations such as multi-pole one face and two face are also acceptable) and defines a magnetic field of at least two hundred and fifty (250) Gauss units, more preferably at least three hundred (300) Gauss units, and most preferably about three hundred and four (304) Gauss units. While stronger or weaker magnetic materials may be used, a magnetic field that is too strong (for example, greater than 1000 Gauss units) would be disadvantageous, as it would too strongly adhere to the base of appliance 13 and not disassociate easily. For this reason, preferred magnetic strip 11 is formed from a flexible extruded sheet formed from ferric oxide, ferrite, alnico, or neodymium and a polymer binder such as rubber or polyvinyl chloride (PVC). An extruded sheet as previously described could be cut to fit the specific dimensions of any appliance 13 and for this reason the measures provided above should not be construed as a limitation on the instant invention.

While an adhesive is not necessary to attach magnetic strip 11 to appliance 13, it may be utilized to affix polymeric kick plate 12 to magnetic strip 11 (not shown). As illustrated in FIGS. 1-6, an embodiment of kick plate 12 defines a width of four inches (4.0"), a length matching that of magnetic strip 11, and may overlap the magnetic strip 11 by about one half inch (0.5"), providing a substrate on the inner, overlapping surface for the attachment adhesive. Kick plate 12 is formed from a polymeric material such as polypropylene, polyethylene, polyvinyl chloride, and the like. Kick plate 12 is not required to be formed out of plastic, but is made from a material that is pliable and deformable enough to bend around the corners of appliance 13, which are typically ninety degree (90°) angles, without causing a dissociative force strong enough to disengage magnetic strip 11 from appliance 13. As best demonstrated in FIGS. 2, 3, and 6, preferred kick plate 12 includes an outwardly angled (i.e. away from appliance 13) bottom portion 14 (that is to say, opposite of magnetic strip 11) configured to form a barrier, for example for articles of clothing such as socks, undergarments, and the like, from inadvertently entering the space between appliance 13 and the floor. In an embodiment of kick plate 12, bottom portion 14 defines an angle of at least fifteen degrees (15°), more preferably at least twenty-five degrees) (25° and most preferred about thirty degrees (30°). While represented in the figures as a straight angle, it should be understood that embodiments of bottom portion 14 may be arcuate. As such, this barrier also includes a structural component which may be necessary as the operating environment of appliance guard 10 is likely to be struck with objects such as laundry baskets, user's feet, and so on.

A method of preventing articles from inadvertently arriving in the void under an appliance may include the step of providing an appliance and an appliance guard including magnetic strip 11 defining a width of three inches (3.0"), a thickness of one sixteenth of an inch (0.062"), and a length of at least ninety inches (90.0") and formed from a material capable of producing a magnetic field of at least three hundred (300) Gauss units affixed to polymeric kick plate 12 defining a width of four inches (4.0"), a length matching that of magnetic strip 11, and may overlap with magnetic strip 11 by about one half inch (0.5"). Kick plate 12 also defines outwardly angled bottom portion 14 distal to magnetic strip 11. The method further includes the steps of magnetically affixing magnetic strip 11 to appliance 13, aligning bottom portion 14 with the floor to ensure no gaps exist, to repel all items which may inadvertently seek access to the void beneath appliance 13.

The illustrations and examples provided herein are for explanatory purposes and are not intended to limit the scope of the appended claims.

I claim:

1. An appliance in combination with an appliance guard, the appliance guard comprising a magnetic strip defining a magnetic field of about three hundred four (304) Gauss units with through-the-thickness polarity, the magnetic strip defining a portion of about half an inch (0.5") in length overlappingly attached to a portion of a deformable polymeric kick plate with a bottom portion defining an outward angle of about thirty degrees (30°), the magnetic strip defining a width of about three inches (3.0"), the kick plate defining a width of about four inches (4.0"), both the magnetic strip and the kick plate defining a length of at least ninety inches (90.0"), whereby the appliance guard is releasably affixed to front and side surfaces of the appliance to prevent the loss of articles there beneath.

2. A method of preventing articles from inadvertently entering a void defined between a floor and an appliance comprising the steps of providing an appliance guard in combination with an appliance as defined in claim 1, and repelling articles which would otherwise access a space beneath the appliance.

* * * * *